US005234016A

United States Patent [19]

Winn

[11] Patent Number: 5,234,016

[45] Date of Patent: Aug. 10, 1993

[54] SIPHON TUBE APPARATUS

[76] Inventor: Boyd E. Winn, 7733 Henefer Ave., Los Angeles, Calif. 90045

[21] Appl. No.: 824,051

[22] Filed: Jan. 23, 1992

[51] Int. Cl.[5] ..... F04F 10/00

[52] U.S. Cl. ..... 137/142; 137/152

[58] Field of Search ..... 137/142, 151, 152

[56] References Cited

U.S. PATENT DOCUMENTS

| | | | |
|---|---|---|---|
| 462,654 | 11/1891 | Dawson | 137/142 |
| 649,313 | 5/1900 | Jewell | 137/151 |
| 2,715,411 | 8/1955 | Plovan | 137/151 |
| 2,830,608 | 4/1958 | Miller | 137/151 X |

*Primary Examiner*—John C. Fox

*Attorney, Agent, or Firm*—Leon Gilden

[57] ABSTRACT

A flexible siphon tube includes a valve mounted within the tube adjacent a lower distal end thereof, wherein the tube is arranged for initial filling with a fluid to be siphoned and permitting subsequent opening of the valve to provide a suction to a rear distal end of the tube to initiate a siphoning from a fluid reservoir to be emptied. A modification of the invention includes a reservoir member mounted to the siphon tube to effect the initial siphon tube filling.

3 Claims, 4 Drawing Sheets

SIPHON TUBE APPARATUS

BACKGROUND OF THE INVENTION

1. Field of the Invention

The field of invention relates to siphon apparatus, and more particularly pertains to a new and improved siphon tube apparatus wherein the same is arranged to provide for a siphon structure formed with a self-starting siphoning action.

2. Description of the Prior Art

Additional siphoning of fluid by use of a siphoning structure is frequently a cumbersome, if not dangerous, procedure such as in the siphoning of gasoline. Various siphoning structure is set forth in the prior art to provide for initial siphoning, wherein such is exemplified in U.S. Pat. No. 4,112,963 to Brubaker wherein a siphon tube includes a cylinder and piston to effect a suctioning through the siphon tube to effect such initial siphoning.

U.S. Pat. No. 3,469,745 to Serio, Jr., et al. sets forth a siphon tube structure to minimize foaming in use of the siphon apparatus.

U.S. Pat. No. 4,797,206 to Lynch sets forth a siphon tube utilizing a protective sleeve retarding mechanical fatigue of the hose at a downstream edge of the handle structure of the siphon.

U.S. Pat. No. 4,095,615 to Ramsauer sets forth a check valve for use in a siphon tube structure.

Accordingly, it may be appreciated that there continues to be a need for a new and improved siphon tube apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of siphon tube apparatus now present in the prior art, the present invention provides a siphon tube apparatus wherein the same utilizes structure to provide for initial filling of a siphon tube, wherein the siphon tube incorporates a valve for selective opening to effect initial suctioning and associated siphoning of a fluid reservoir into a receiving container. As such, the general purpose of the present invention, which will be described subsequently in greater detail, is to provide a new and improved siphon tube apparatus which has all the advantages of the prior art siphon tube apparatus and none of the disadvantages.

To attain this, the present invention provides a flexible siphon tube including a valve mounted within the tube adjacent a lower distal end thereof, wherein the tube is arranged for initial filling with a fluid to be siphoned and permitting subsequent opening of the valve to provide a suction to a rear distal end of the tube to initiate a siphoning from a fluid reservoir to be emptied. A modification of the invention includes a reservoir member mounted to the siphon tube to effect the initial siphon tube filling.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved siphon tube apparatus which has all the advantages of the prior art siphon tube apparatus and none of the disadvantages.

It is another object of the present invention to provide a new and improved siphon tube apparatus which may be easily and efficiently manufactured and marketed.

It is a further object of the present invention to provide a new and improved siphon tube apparatus which is of a durable and reliable construction.

An even further object of the present invention is to provide a new and improved siphon tube apparatus which is susceptible of a low cost of manufacture with regard to both materials and labor, and which accordingly is then susceptible of low prices of sale to the consuming public, thereby making such siphon tube apparatus economically available to the buying public.

Still yet another object of the present invention is to provide a new and improved siphon tube apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
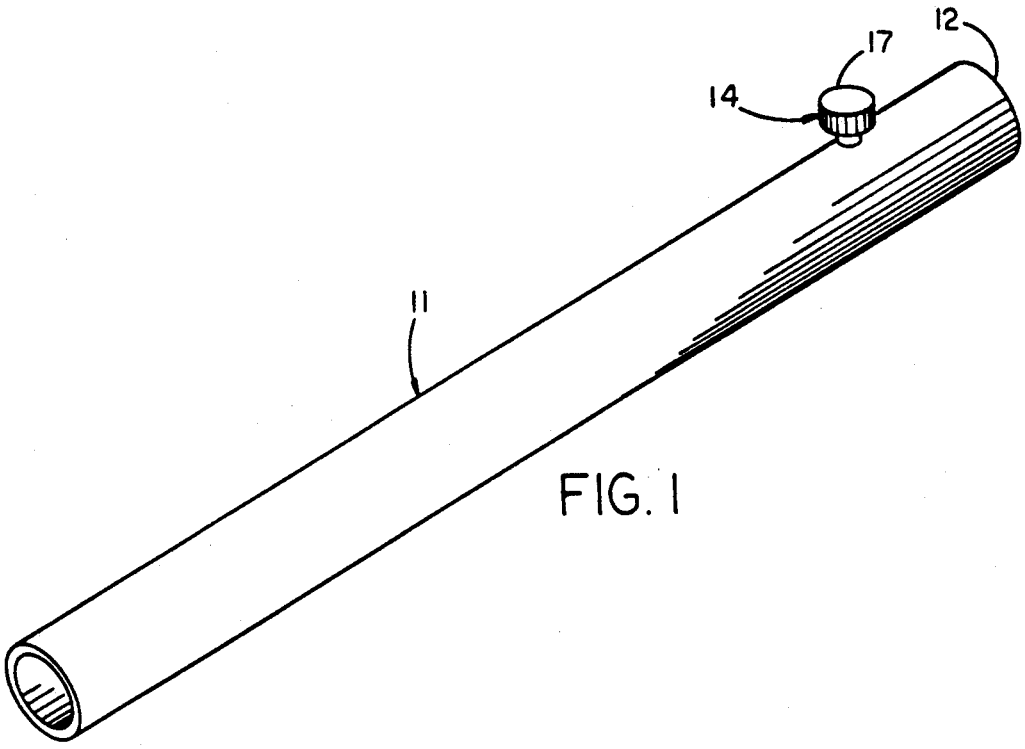
FIG. 1 is an isometric illustration of the flexible siphon tube utilized by the invention.

With reference now to the drawings, and in particular to FIGS. 1 to 8 thereof, a new and improved siphon tube apparatus embodying the principles and concepts of the present invention and generally designated by the reference numeral 10 will be described.

Figure 2:
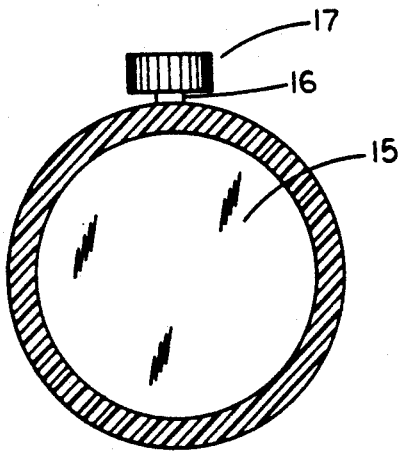
FIG. 2 is an orthographic cross-sectional illustration of the siphon tube valve in a closed configuration.
Figure 3:
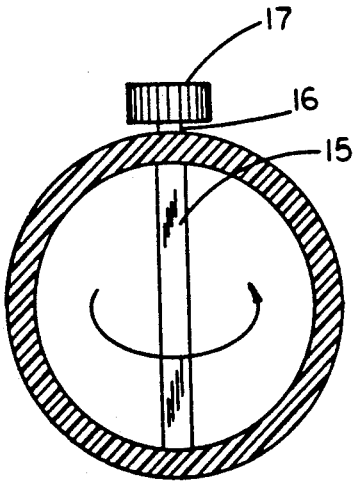
FIG. 3 is an orthographic cross-sectional illustration of the siphon tube valve in an opened configuration.
Figure 4:
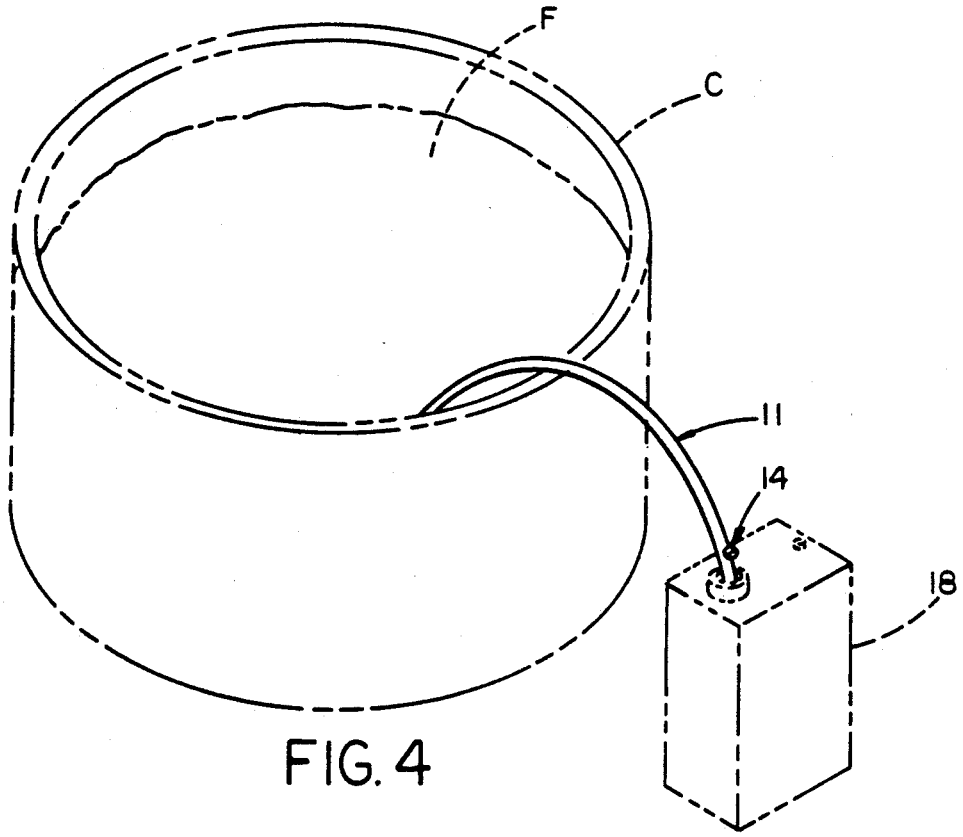
FIG. 4 is an isometric illustration of a siphon tube structure in use.

More specifically, the siphon tube apparatus 10 of the instant invention essentially comprises a flexible tube 11 formed with a forward distal end 12 and a rear distal end 13. A valve member 14 is mounted into the flexible tube 11 adjacent the forward distal end 12, with the valve member 14 including a valve member plate 15 formed by a predetermined diameter substantially equal to the predetermined diameter defined within the flexible tube 11, such as illustrated in the FIGS. 2 and 3. A valve shaft 16 diametrically directed through the tube 11 and the shaft 16 rotatably mounts the valve plate 15 Within the flexible tube 11. A handle 17 mounted to an upper distal end of the shaft 16 permits selective rotation of the shaft 16 and the plate 15 from an opened configuration, as illustrated in FIG. 2, effecting closure of the tube 11 to a second position, as illustrated in FIG. 3, wherein the plate 15 is arranged in the second position coaxially aligned with an axis of a tube 11 from a first position, wherein the plate 15 extends orthogonally across the axis defined by the tube 11 in effecting closure of the tube 11.

Figure 5:
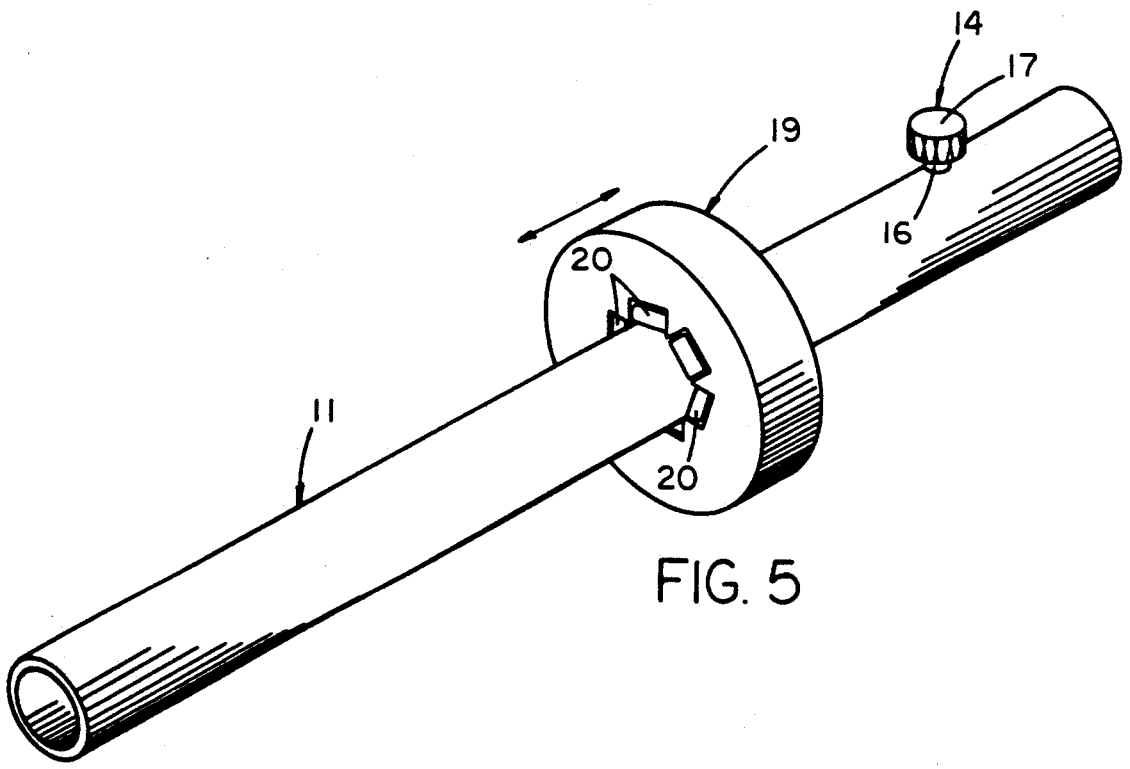
FIG. 5 is an isometric illustration of the siphon tube utilizing a magnetic mounting collar.
Figures 6, 7:
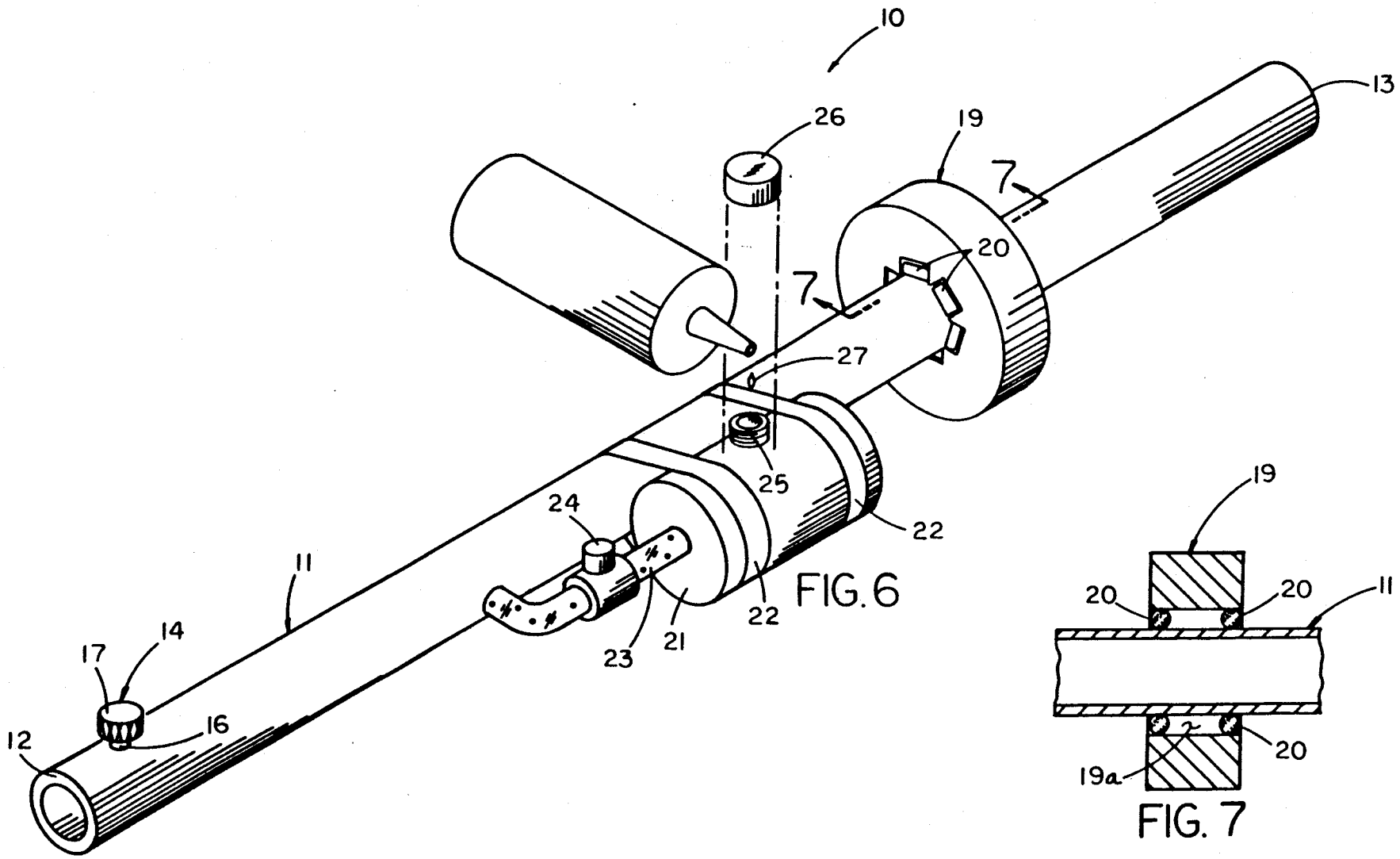
FIG. 6 is an isometric illustration of the invention in a complete configuration.
FIG. 7 is an orthographic view taken along the lines 7—7 of FIG. 6 in the direction indicated by the arrows.
Figure 8:
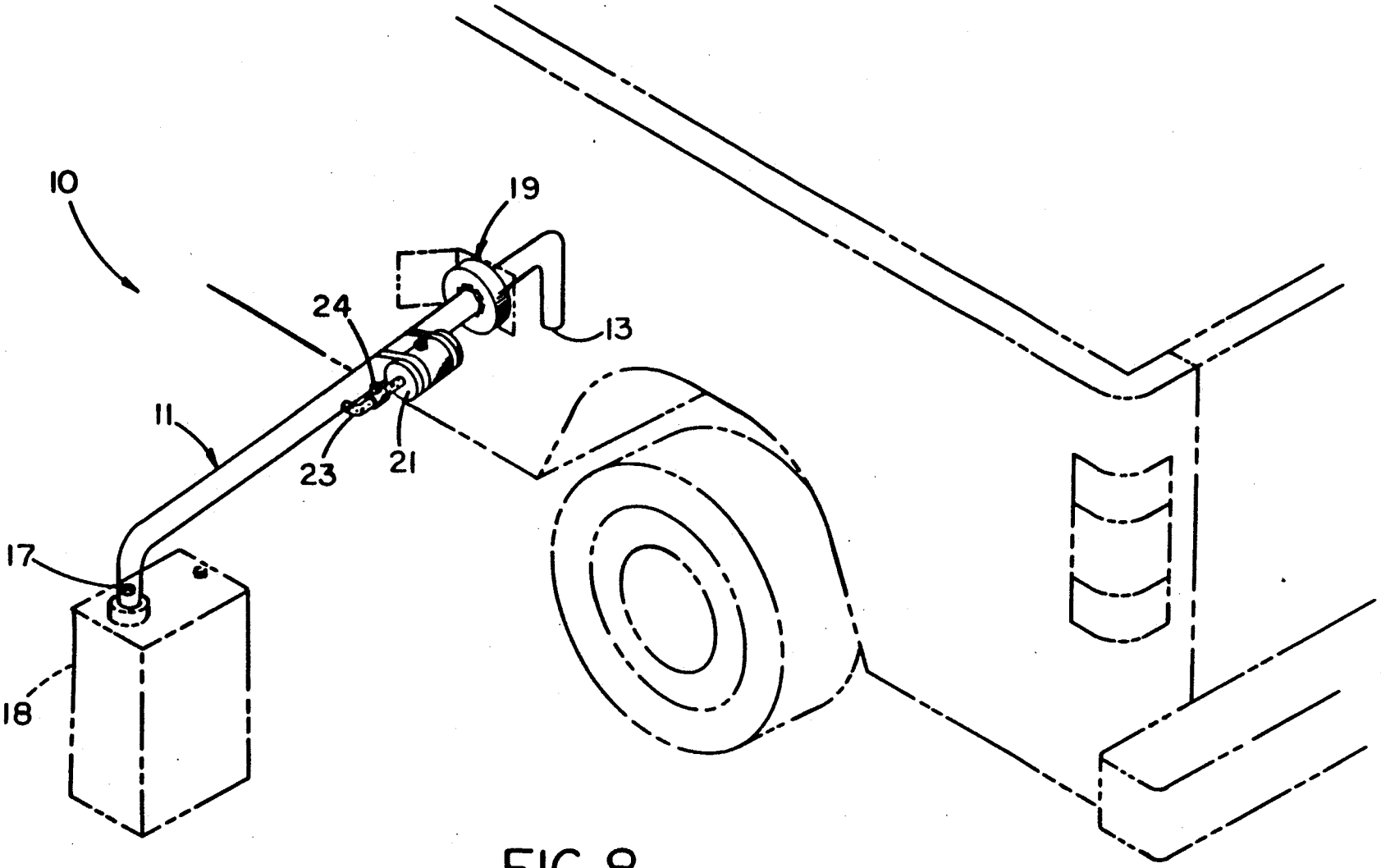
FIG. 8 is an isometric illustration of the invention in use.

In use of the invention in a base form, the tube 11 is initially filled with a fluid "F" as contained within the container "C". Subsequently, the valve 14 is opened to the second position, as illustrated in the FIG. 3, and siphoning action is effected by a suction directed from the fluid directed through the forward distal end 12 into the receiving container 18. The apparatus, and more specifically the flexible tube 11 as illustrated in FIG. 5, includes a magnetic collar 19 receiving the flexible tube 11 coaxially of a central coaxial bore 19*a* of the collar 19. The collar 19 is formed of a ferromagnetic material for adherence to a vehicular body, such as illustrated in FIG. 8, to provide proper positioning in mounting of the tube in use. Roller bearings 20 are mounted coextensively about an interior perimeter surface of the coaxial bore 19*a* to rotatably receive the tube 11 therethrough in a non-binding relationship relative to the collar 19.

A fluid reservoir 21 is mounted to the flexible tube 11 by any convenient means, wherein securement bands 22 are illustrated in the securement of the reservoir to the tube 11. The fluid reservoir 21 is mounted in a spaced relationship relative to the forward distal end 12 defined by a first spacing and spaced from the rear distal end by a second spacing, wherein the first spacing is substantially greater than the second spacing to provide for a volumetric filling of the tube 11 substantially greater than one-half the predetermined length of the flexible tube 11 to provide for adequate suctioning being effected through the rear distal end 13 upon the projection of fluid through the forward distal 12 through the valve member 14. The fluid reservoir 21 includes an outlet conduit 23 in fluid communication with the fluid reservoir 21 and the flexible tube 11, wherein an outlet conduit valve 24 mounted within the outlet conduit effects selective fluid flow therethrough. The reservoir fluid 27 is typically of identical fluid to be withdrawn, such as the fluid "F" from an associated storage container such as gasoline tank within the vehicle, as illustrated in FIG. 8. A reservoir fill opening 25 includes a removable cap 26 mounted to the fill opening 25 to provide for selective filling of the fluid reservoir 21 with a fluid 27 to match the reservoir fluid "F".

Subsequently, upon directing fluid through the outlet conduit 23 and effect a volumetric filling of the flexible tube 11 to be equal substantially greater than one-half the volumetric capacity of the tube 11, the valve member 14 is opened and adequate suctioning is directed from the rear distal end 13 to effect proper suctioning and subsequent siphoning of the container "C" or any storage container to be siphoned.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A siphon tube apparatus, comprising, a flexible tube, the flexible tube including a forward distal end spaced from a rear distal end, and .

a valve member mounted within the flexible tube adjacent the forward distal end, the flexible tube defined by a predetermined diameter, and the valve member including a valve plate rotatably mounted within the flexible tube, wherein the valve plate is defined by a plate diameter equal to the predetermined diameter, and a valve shaft fixedly and diametrically directed through the valve plate, the valve shaft extending through the flexible tube and terminating in a shaft handle to permit manual rotation of the valve plate from a first position to a second position, the flexible tube including a tube axis and the valve plate oriented orthogonally relative to the tube axis in the first position and parallel to the tube axis in the second position, and a magnetic collar, the magnetic collar formed of a ferromagnetic material, and including a central coaxial bone directed through the magnetic collar, the central coaxial bore including a continuous perimeter of roller bearings coextensive about the coaxial bore slidably receiving the flexible tube through the roller bearings to minimize damage to the flexible tube directed through the magnetic collar.

2. An apparatus as set forth in claim 1 including a fluid reservoir mounted to the flexible tube, and securement means secured to the fluid reservoir and the flexible tube for securing the fluid reservoir to the flexible tube, and the magnetic collar is mounted to the flexible tube between the fluid reservoir and the rear distal end, the fluid reservoir is spaced from the forward distal end a first spacing and the fluid reservoir is spaced from the rear distal end a second spacing, wherein the first spacing is greater than the second spacing, and the fluid reservoir including an outlet conduit, the outlet conduit in fluid communication with the fluid reservoir and the flexible tube, the outlet conduit including an outlet conduit valve permitting respective fluid flow from the fluid reservoir to the flexible tube, and the fluid reservoir including a predetermined volumetric capacity and the flexible tube includes a further volumetric capacity within the flexible tube, wherein the volumetric capacity of the fluid reservoir is equal to at least one-half of the further volumetric capacity of the flexible tube.

3. An apparatus as set forth in claim 2 wherein the fluid reservoir includes a fill opening, and the fill opening includes a cap member removably mounted relative to the fill opening, and the flexible tube rear distal end is arranged for projection within a storage container, the storage container including a container fluid, and fill means containing such container fluid positioned for directing said container fluid into the fluid reservoir prior to siphoning of the storage container.

* * * * *